US007053861B2

(12) United States Patent
Rawnick et al.

(10) Patent No.: US 7,053,861 B2
(45) Date of Patent: May 30, 2006

(54) TAPER CONTROL OF REFLECTORS AND SUB-REFLECTORS USING FLUIDIC DIELECTRICS

(75) Inventors: James Rawnick, Palm Bay, FL (US); Stephen Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/115,899

(22) Filed: Apr. 27, 2005

(65) Prior Publication Data

US 2005/0195120 A1 Sep. 8, 2005

Related U.S. Application Data

(62) Division of application No. 10/387,208, filed on Mar. 11, 2003, now Pat. No. 6,909,404.

(51) Int. Cl.
*H01Q 15/14* (2006.01)
*H01Q 13/00* (2006.01)

(52) U.S. Cl. ..... 343/912; 343/781 R

(58) Field of Classification Search ..... 343/912, 343/781 R, 781 P, 781 CA, 757, 779
See application file for complete search history.

(56) References Cited

U.S. PATENT DOCUMENTS 5,162,972 A 11/1992 Gripshover et al.
6,515,235 B1 2/2003 Moller
6,806,416 B1 10/2004 Pike
6,870,439 B1 3/2005 Brown et al.
6,873,229 B1 3/2005 Pike
6,873,305 B1 3/2005 Rawnick et al.
6,876,274 B1 4/2005 Brown et al.
6,876,278 B1 4/2005 Rawnick et al.
6,879,297 B1 4/2005 Brown et al.
6,909,404 B1 * 6/2005 Rawnick et al. ..... 343/781 R
6,930,653 B1 * 8/2005 Rawnick et al. ..... 343/912
2004/0095202 A1 5/2004 Brown et al.
2004/0095208 A1 5/2004 Rawnick et al.
2004/0124939 A1 7/2004 Brown et al.
2004/0124948 A1 7/2004 Brown et al.
2004/0125019 A1 7/2004 Rawnick et al.
2004/0155727 A1 8/2004 Rawnick et al.
2004/0160382 A1 8/2004 Rawnick et al.
2004/0178865 A1 9/2004 Rawnick et al.
2004/0207481 A1 10/2004 Brown et al.
2004/0207494 A1 10/2004 Brown et al.
2004/0227694 A1 11/2004 Rawnick et al.
2004/0252054 A1 12/2004 Brown et al.
2004/0252058 A1 12/2004 Rawnick et al.
2004/0252069 A1 12/2004 Rawnick et al.
2005/0007209 A1 1/2005 Brown et al.
2005/0017819 A1 1/2005 Brown et al.

(Continued)

*Primary Examiner*—Trinh Vo Dinh
(74) *Attorney, Agent, or Firm*—Sacco & Associates, PA

(57) ABSTRACT

A reflector antenna (100) includes a reflector unit (191) having at least one cavity (192) disposed in the reflector unit, at least one fluidic dielectric (180) having a permittivity and a permeability, and at least one composition processor (101) adapted for dynamically changing a composition of the fluidic dielectric to vary at least the permittivity or permeability in at least one cavity for the purpose of dynamically altering the illumination taper of the reflector antenna. The antenna further comprises a controller (136) for controlling the composition processor in response to a control signal (137).

13 Claims, 4 Drawing Sheets

U.S. PATENT DOCUMENTS

2005/0017915 A1 1/2005 Brown et al.
2005/0024167 A1 2/2005 Rawnick et al.
2005/0024629 A1 2/2005 Pike et al.
2005/0030119 A1 2/2005 Rawnick et al.
2005/0030133 A1 2/2005 Brown et al.
2005/0030240 A1 2/2005 Rawnick et al.

* cited by examiner

PRIOR ART

TAPER CONTROL OF REFLECTORS AND SUB-REFLECTORS USING FLUIDIC DIELECTRICS

CROSS-REFERENCES TO RELATED APPLICATIONS

This application is a DIV of U.S. patent application Ser. No. 10,387,208, filed Mar. 11, 2003, now U.S. Pat. No. 6,909,404, the subject matter thereof incorporated herein in its entirety.

BACKGROUND OF THE INVENTION

1. Statement of the Technical Field

The present invention relates to the field of antennas, and more particularly to dynamically adjustable reflectors and sub-reflectors using fluidic dielectrics.

2. Description of the Related Art

Typical satellite antenna systems use either parabolic reflectors or shaped reflectors to provide a specific beam coverage, or use a flat reflector system with an array of reflective printed patches or dipoles on the flat surface. These "reflectarray" reflectors used in antennas are designed such that the reflective patches or dipoles shape the beam much like a shaped reflector or parabolic reflector would, but are much easier to manufacture and package on a spacecraft. These antennas will be initially configured to reduce side lobes or to avoid reflecting side lobes.

Since satellites typically are designed to provide a fixed satellite beam coverage for a given signal and may be limited in bandwidth by the structure of the reflectors. For example, Continental United States (CONUS) beams are designed to provide communications services to the entire continental United States. Once the satellite transmission system is designed and launched, changing the beam patterns to improve the operational bandwidth would be difficult. Additionally, antennas using feeds operating over a range of frequencies may also experience performance degradation due to appreciable side lobes in given frequency range. The side lobes are usually a result of edge diffraction of the radiation from the feed. The diffraction spreads the radiation into unwanted directions and causes interference with other electronic systems. A proper edge treatment can reduce the effect of the side lobes and improve overall antenna performance. Commonly used methods include serrated edges and rolled back edges. Another system by Ohio State University uses sputtered carbon on the surface of the reflector to provide different values of resistance. All these solutions are fine for fixed configurations that don't require adjustments. Even fixed configurations may require adjustments over time for various reasons such as environmental conditions or normal wear and tear causing system degradation.

A microwave antenna projects a traveling microwave onto an aperture in free space. The electromagnetic field at each point as defined by the projection can be considered a source of a secondary spherical wave known as Huygens' wavelet. The envelope of all Huygens' wavelets emanating from the antenna aperture at any instant of time is then used to describe the transmitting electromagnetic radiation from the antenna at a later instant of time. This is known as the famed Huygens-Fresnel Principle and mathematically can be represented by the Rayleigh-Sommerfeld diffraction formula, which is a Fourier type integration. The assumption with fixed antennas is that their aperture must be finite in size which imposes a window on the Rayleigh-Sommerfeld diffraction formula for an untreated microwave antenna. It is well known in Fourier analysis that a window discontinuous at the aperture edges leads to high side lobes. These side lobes can be reduced by employing smooth tapered windows before evaluating the Fourier transformation. The edge treatment of microwave antennas corresponds to imposing a smooth tapered window onto the Rayleigh-Sommerfeld diffraction formula. The serrated and rolled edge treatments differ in methods of tapering. The former is restricted to the magnitude tapering of the electromagnetic field at the aperture of a microwave antenna, and the latter is mainly confined to phase tapering with little controls on the magnitude. The electromagnetic field has two independent components—magnitude and phase. Any abrupt change in either component will lead to high side lobes. Both serrated and rolled edge treatments are restricted to a single component, neglecting the other. The abrupt change can not be optimally removed with either of these two methods. The present invention can treat both components simultaneously, hence provide a better optimum method than either of them, therefore leading to much better side lobe reduction.

Passive reflectors are generally broadband structures, and in fact the principal beam direction from a reflector system is typically independent of frequency. However, beamwidth and sidelobe directions are not independent of frequency. In mathematical terms, this is because the domain of the Rayleigh-Sommerfeld integration scales with wavelength. Thus a shaped beam designed to cover the CONUS will be correctly sized at only a single frequency, and will be too large at lower frequencies, and too small at higher frequencies. In addition, although the reflector functions over a broad frequency range, the radiation pattern of the feed structure is typically frequency dependent, and the optimum reflector size and shape for a particular feed changes with frequency. Reflectarrays have the additional complication that the array elements will have frequency dependence. The combination of all these factors limits the frequency range of conventional shaped beam reflector designs.

The need to change the beam pattern provided by the satellite and further account for side lobe effects has become more desirable with the advent of direct broadcast satellites that provide communications services to specific areas and possibly on different frequencies ranges. Without the ability to change beam patterns and coverage areas as well as to flexibly use multiple frequency ranges, additional satellites must be launched to provide the services to possible future subscribers, which increases the cost of delivering the services to existing customers.

Some existing systems are designed with minimal flexibility in the delivery of communications services. For example, a symmetrical Cassegrain antenna that uses a movable feed horn, defocuses the feed and zooms circular beams over a limited beam aspect ratio of 1:2.5. This scheme has high sidelobe gain and low beam-efficiency due to blockage by the feed horn and the subreflector of the Cassegrain system. Further, this type of system splits or bifurcates the main beam for beam aspect ratios greater than 2.5, resulting in low beam efficiency values. Other systems attempt to alter beam width and gain by using multiple feed horns. In any event, most of these systems will have a main reflected signal that will be interfered with by a side lobe of the radiator or feed horn.

In another system as shown in FIG. 1, a dynamic reflector surface comprising an array of tunable reflective surfaces is used instead of a fixed reflector surface. Each element of the array can be tuned separately to change the phase during the process of reflection, and thus the beam pattern generated by the array of tunable reflectors can be changed in-flight in a simple manner. Each reflecting element in the array is a horn reflecting device which reflects an electric field emanating from a single feed horn. Each horn in the array has the capability of changing the phase during the process of incidence and reflection. This phase shift can then be used to change the shape of the beam emanating from the array. The phase shift can be incorporated by either using a movable short or by using a variable phase-shifter inside the horn and a short. By using "phase-shifting" which can be controlled on-orbit, a relatively simple reconfigurable antenna can be designed. This approach is much simpler than an active array in terms of cost and complexity.

More specifically, FIG. 1 illustrates a front, side, and isometric view of the existing horn reflect array as described in U.S. Pat. No. 6,429,823. Reflect array 200 is illuminated with RF energy from feed horn 202. Reflect array 200 comprises a plurality of reflective elements 204 that are configured in a reflector array 206. Side view 208 shows that feed horn 202 is pointed at the open end 210 of reflective element 204. Side view 208 also shows that reflector array 206 can be a curved array. Further, front view 212 and isometric view 214 show that reflective elements 204 can be placed in a circular arrangement for reflector array 206. Each reflective element 204 reflects a portion of the incident RF energy, and by changing the respective phase for each reflective element 204, the respective phase of the portion of the reflected RF energy for each respective reflective element 204 can be changed. By changing the phase of each portion of the reflected RF energy, different beam patterns can be generated by the horn reflect array. Although the reflector array 206 provides lower non-recurring costs for a satellite and can generate a plurality of different shaped beam patterns without reconfiguring the physical hardware, e.g., without moving the location of the feed horn 202 and the reflective elements 204 in the reflector array 206, the design is still more complicated than needed to obtain similar results. Fortunately, the only thing that must change from mission to mission using the reflect array 200 is the programming of the reflective elements 204.

In any event, a programmable array such as the reflector array 206 can be reconfigured on-orbit. Satellites using the reflector array 206 can be designed for use in clear sky conditions, and, when necessary, the beams emanating from the reflector array 206 can be shaped to provide higher gains over geographic regions having rain or other poor transmission conditions, thus providing higher margins during clear sky conditions.

It can be seen, then, that there is a need in the art for an antenna system that can be alternatively reconfigured in-flight to reduce the effects of side lobes from one or more sources (feeds) without the need for complex systems as discussed above. It can also be seen that there is a need in the art for a communications system that can be reconfigured in-flight that has high beam-efficiencies and high beam aspect ratios. An alternative arrangement for achieving the advantages of the antenna of FIG. 1 and other advantages as will be further described below utilizes fluidic dielectrics in accordance with the present invention.

Two important characteristics of dielectric materials are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly affects the electrical length of a transmission line and therefore the amount of delay introduced to signals that traverse the line.

Further, ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the transmission line structures as well as the physical geometry and spacing of the line structures.

For a given geometry, an increase in dielectric permittivity or permeability necessary for providing increased time delay will generally cause the characteristic impedance of the line to change. However, this is not a problem where only a fixed delay is needed, since the geometry of the transmission line can be readily designed and fabricated to achieve the proper characteristic impedance. Analogously, wave propagation delays and energy beam patterns through dielectric materials in reflector and/or sub-reflector based antenna systems are typically designed accordingly with a fixed dielectric permittivity or permeability. When various time delays are needed for specific energy shaping or beam forming requirements, however, such techniques have traditionally been viewed as impractical because of the obvious difficulties in dynamically varying the permittivity and/or permeability of a dielectric board substrate material. Accordingly, the only practical solution has been to design variable delay lines using conventional fixed length RF transmission lines with delay variability achieved using a series of electronically controlled switches. Such schemes would be impracticable and overly complicated for a reflector or sub-reflector based antenna.

SUMMARY OF THE INVENTION

The invention concerns an antenna utilizing a reflector and/or sub-reflector which includes at least one cavity and the mixture of fluidic dielectric in the cavity or cavities. A pump or a composition processor, for example, can be used to mix the fluidic dielectric to the cavity in response to a control signal. A propagation delay or beam pattern or gain of a radiated signal through the antenna is selectively varied by manipulating the fluidic dielectric within the cavity or cavities.

The fluidic dielectric can be comprised of an industrial solvent. If higher permeability is desired, the industrial solvent can have a suspension of magnetic particles contained therein. The magnetic particles can be formed of a wide variety of materials including those selected from the group consisting of ferrite, metallic salts, and organo-metallic particles.

In accordance with a first embodiment of the present invention, a reflector antenna comprises a reflector unit having at least one cavity disposed in the reflector unit, at least one fluidic dielectric having a permittivity and a permeability that can be selectively disposed within one or more cavities, and at least one composition processor adapted for dynamically changing a composition of the fluidic dielectric to vary at least the permittivity or permeability in at least one cavity. The antenna further comprises a controller for controlling the composition processor in response to a control signal.

In accordance with a second embodiment of the present invention, a reflector antenna comprises a reflector unit having at least one cavity disposed in the reflector unit, at least two fluidic dielectric each having a permittivity and a permeability, and at least one fluidic pump unit for moving at least two fluidic dielectric among at least one cavity and a reservoir and for mixing the at least two fluid dielectric in response to a control signal.

In yet another embodiment of the present invention, a method for energy shaping a radio frequency (RF) signal comprises the steps of propagating the RF signal toward a reflector in a reflector antenna and dynamically mixing at least two fluidic dielectric to reduce one or more sidelobes present in the resultant far-field radiated antenna pattern of the reflector antenna system.

DETAILED DESCRIPTION OF THE INVENTION

Figure 1:
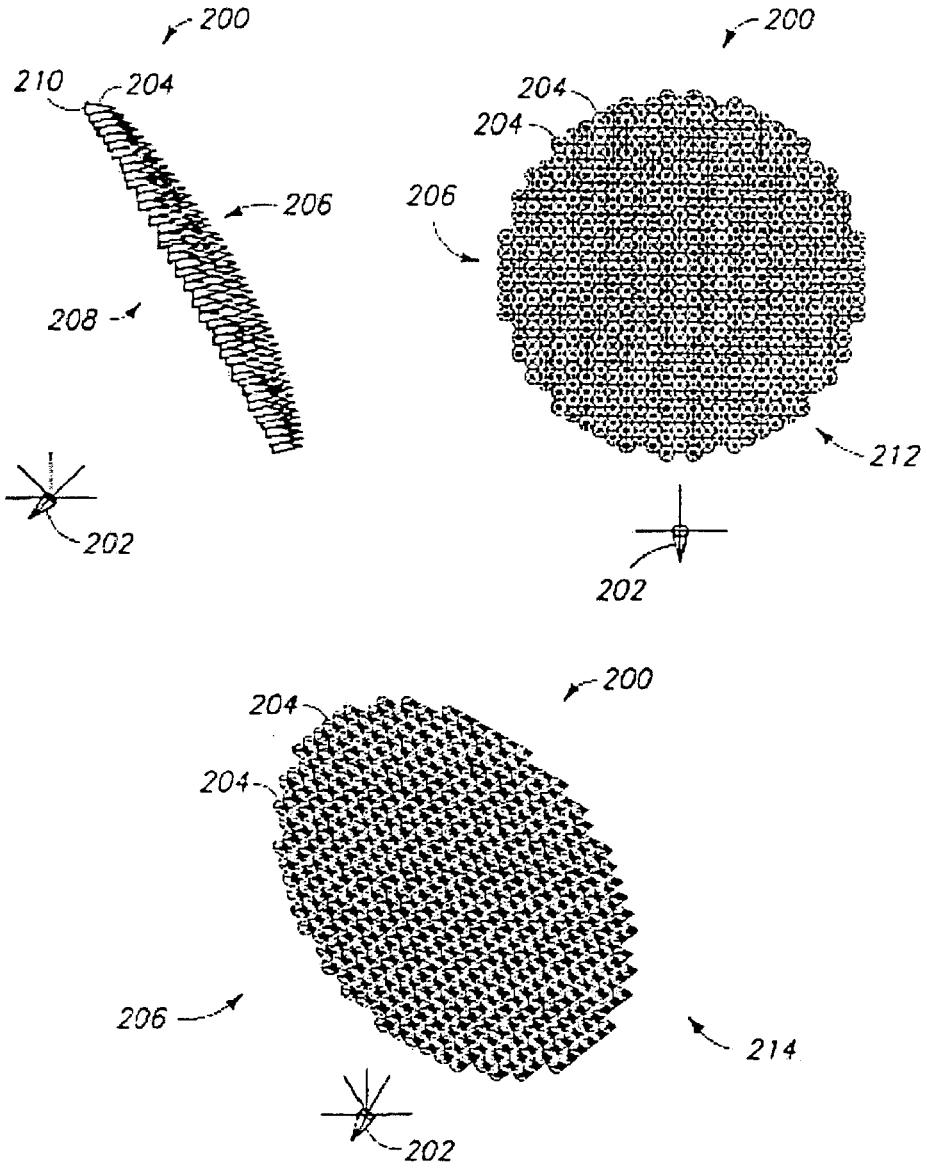
FIG. 1 illustrates a front, side, and isometric view of a horn reflect array of an existing antenna system.

Although the antenna of FIG. 1 provides more flexibility than a conventional satellite reflector antenna, it is the ability to vary the dielectric value of a reflective element in the antenna of the present invention that enables it to be used in more than just a particular application or operating range without the complexities of a complete array of reflective elements. Reflectors and sub-reflectors in prior antennas all have static or fixed dielectric values. In contrast, the present invention utilizes a fluidic cavity or cavities as shall hereinafter be described in greater detail to provide even greater design flexibility for an antenna capable of further applications and wider operating ranges that further overcomes the detriments associated with side lobes.

Figure 2:
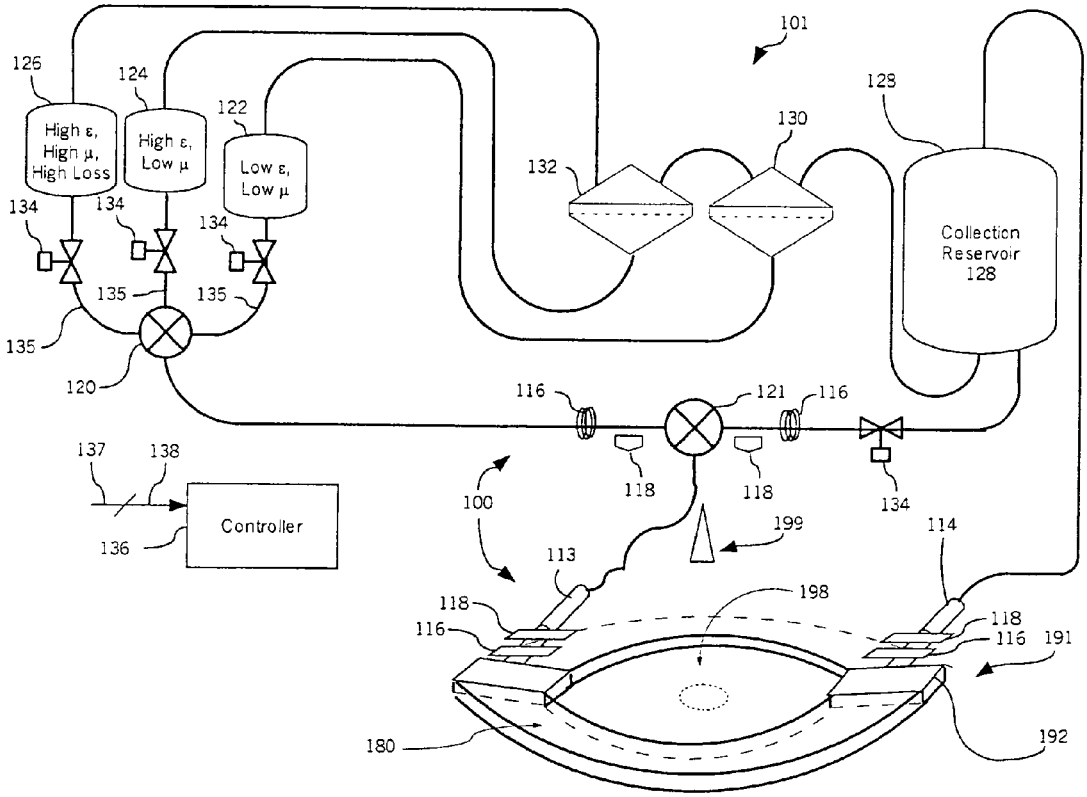
FIG. 2 is a schematic diagram of a dynamically adjustable reflector antenna system in accordance with the present invention.
Figure 2A:
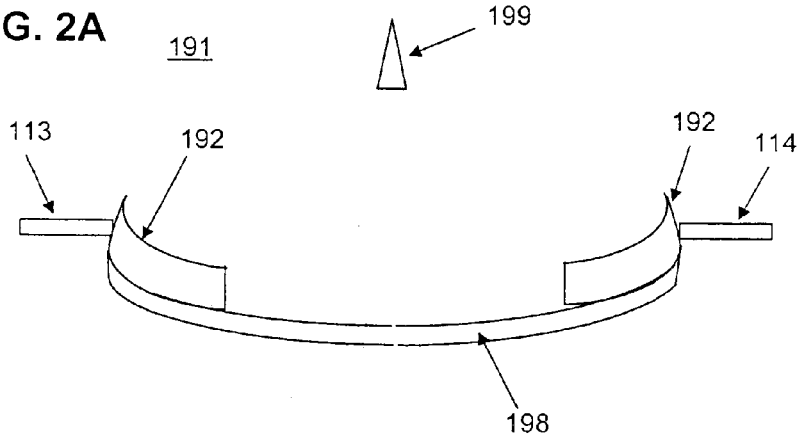
FIG. 2A is a side view of a portion of the antenna system of FIG. 2.

Referring to FIG. 2, a reflector antenna 100 in accordance with the present invention preferably comprises a reflector unit 191 having at least one cavity 192 disposed in or on the reflector unit 191 and at least one fluidic dielectric having a permittivity and a permeability. The reflector antenna 100 can also include at least one composition processor 101 adapted for dynamically changing a composition of the fluidic dielectric (180) to vary at least one of the permittivity and the permeability in at least one cavity 192 and a controller 136 for controlling the composition processor 101 in response to a control signal 137 on controller input line 138. The reflector antenna can also comprise a feed 199 for radiating a signal towards the reflector unit and a solid dielectric substrate portion 198. Referring to FIG. 2A, a side view of the reflector unit 191 is illustrated including the cavity 192, solid dielectric substrate portion 198, feed or horn 199 and conduit feeds 113 and 114 into the cavity 192.

The composition processor 101 can be comprised of a plurality of fluid reservoirs containing component parts of fluidic dielectric 180. These can include: a first fluid reservoir 122 for a low permittivity, low permeability component of the fluidic dielectric; a second fluid reservoir 124 for a high permittivity, low permeability component of the fluidic dielectric; a third fluid reservoir 126 for a high permittivity, high permeability, high loss component of the fluidic dielectric. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the fluidic dielectric and a fourth fluid reservoir can be provided to contain a component of the fluidic dielectric having a high loss tangent.

A cooperating set of proportional valves 134, mixing pumps 120, 121, and connecting conduits 135 can be provided as shown in FIG. 1 for selectively mixing and communicating the components of the fluidic dielectric 180 from the fluid reservoirs 122, 124, 126 to the cavity 192. The composition processor also serves to separate out the component parts of fluidic dielectric 180 so that they can be subsequently re-used to form the fluidic dielectric with different attenuation, permittivity and/or permeability values. All of the various operating functions of the composition processor can be controlled by controller 136.

Operationally, the composition processor 101 starts with the controller 136 checking to see if an updated control signal 137 has been received on a controller input line 138. If so, then the controller 136 determines an updated permittivity value and/or an updated permeability value. The updated values can be obtained using a look-up table in one embodiment. The controller can determine an updated permittivity value for matching the appropriate taper indicated by the control signal 137. For example, the controller 136 can determine the permeability of the fluidic components based upon the fluidic component mix ratios or discrete volume ratios of different fluidic components and determine an amount of permittivity that is necessary to achieve the indicated impedance for the determined permeability.

The controller 136 can cause the composition processor 101 to begin mixing two or more component parts in a proportion to form fluidic dielectric that has the updated values determined earlier. The mixing process can be accomplished by any suitable means. For example, in FIG. 2 a set of proportional valves 134 and mixing pump 120 are used to mix component parts from reservoirs 122, 124, 126 appropriate to achieve the desired updated permittivity and permeability values.

Figure 3:
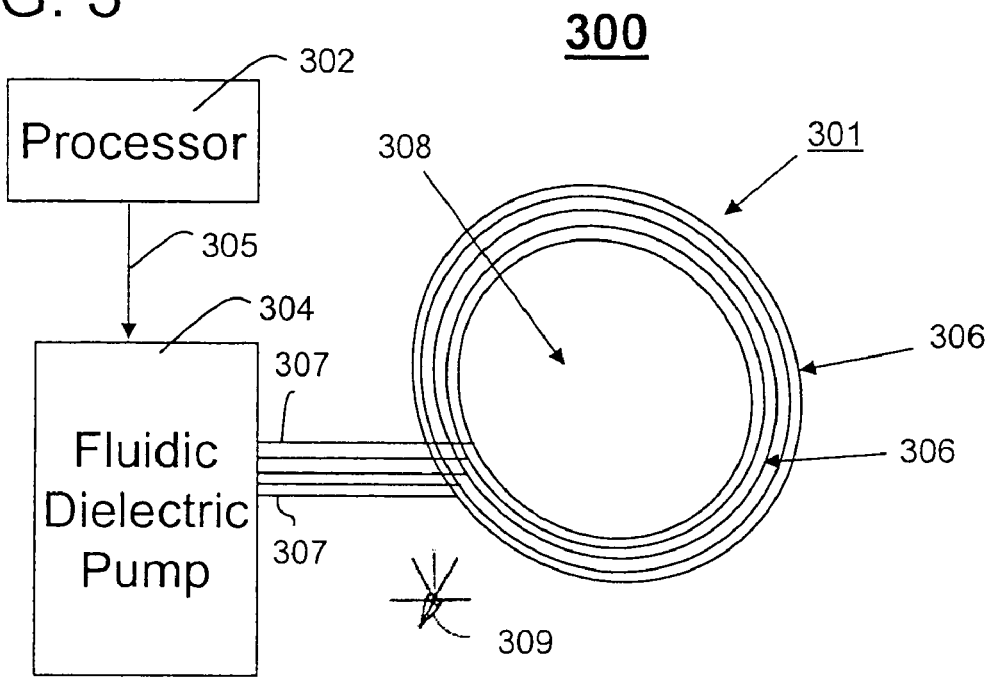
FIG. 3 is another schematic diagram of a dynamically adjustable reflector antenna system in accordance with the present invention.
Figure 4:
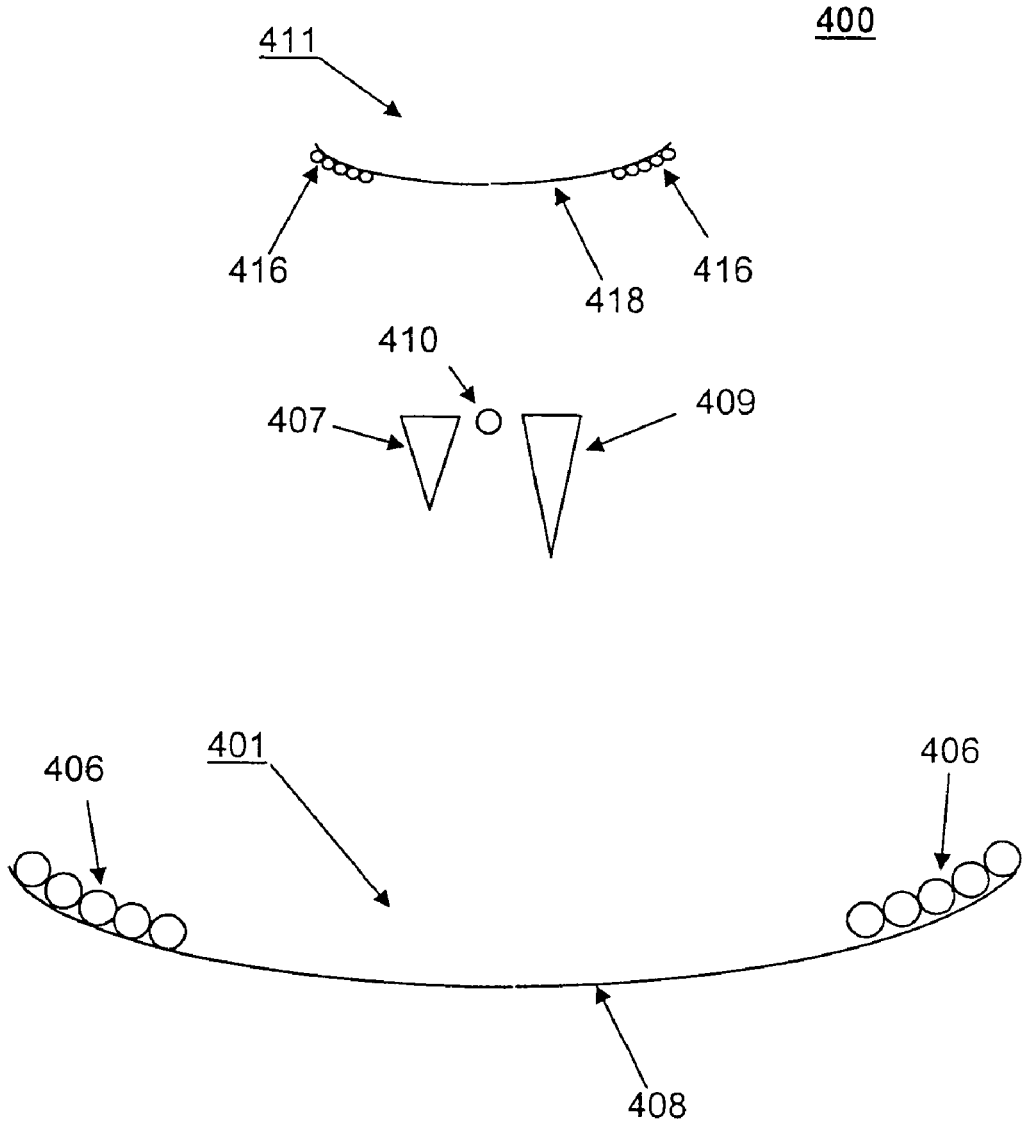
FIG. 4 is a side view of an adjustable reflector and sub-reflector antenna system in accordance with the present invention.

The controller 136 can cause the newly mixed fluidic dielectric (or discrete and separate volumes of different mixed fluidic dielectric-see FIGS. 3 and 4) 180 to be circulated into the cavity 192 through a second mixing pump 121 or through discrete cavities as shown in FIGS. 3 & 4. The controller 136 can check one or more sensors 116,118 to determine if the fluidic dielectric being circulated through the cavity 192 has the proper values of permittivity and permeability. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The sensors can be located as shown, at the input to mixing pump 121. Sensors 116, 118 are also preferably positioned to measure the loss tangent, permittivity and permeability of the fluidic dielectric passing through input conduit 113 and output conduit 114. Note that it is desirable to have a second set of sensors 116,118 at or near the resonant cavity 192 so that the controller can determine when the fluidic dielectric with updated loss tangent, permittivity and permeability values has completely replaced any previously used fluidic dielectric that may have been present in the resonant cavity 192.

The controller 136 can compare the measured loss tangent to the desired updated loss tangent value previously determined. If the fluidic dielectric does not have the proper updated loss tangent value, the controller 136 can cause additional amounts of high loss tangent component part to be added or removed to the mix (or to or from discrete cavities within the resonant cavity) from reservoir 126.

The controller 136 can also compare the measured permittivity and permeability with a desired updated permittivity or permeability value(s) determined. If the updated permittivity or permeability value(s) has not been achieved, then high or low permittivity or permeability component parts are mixed, added or removed as necessary. The system can continue circulating the fluidic dielectric through the cavity 192 until the loss tangent, permeability and/or permittivity passing into and out of the cavity 192 are the proper value indicated to obtain a proper taper configuration. Once the loss tangent, permeability, and/or permittivity are the proper value, the process can continue to wait for the next updated control signal.

Significantly, when updated fluidic dielectric is required, any existing fluidic dielectric would likely require circulation out of the cavity 192. Any existing fluidic dielectric not having the proper loss tangent and/or permittivity can be deposited in a collection reservoir 128. The fluidic dielectric deposited in the collection reservoir 128 can thereafter be re-used directly as a fourth fluid by mixing with the first, second and third fluids or separated out into its component parts so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir. Those skilled in the art will recognize that the specific process used to separate the component parts from one another will depend largely upon the properties of materials that are selected and the invention. Accordingly, the invention is not intended to be limited to the particular process outlined above.

The general principle of operation of the present invention is simple. When the cavities or channels are empty, the system behaves as a base reflector system, without any illumination taper. When fluid channels or cavities over the reflector edges are filled with dielectric fluid, the system provides additional delay in the reflection, in the manner of rolled edges. When the fluid channels or cavities are filled with lossy fluid, the system provides amplitude taper in the manner of serrated edges. With a lossy, high epsilon fluid the system provides control of both amplitude and phase. Although concentric channels or cavities around the outer region of a circular reflector or subreflector are shown in FIGS. 2 and 3 to give the desired control, the present invention should not be limited thereto. For example, the cavities or channels can form a rectangular matrix of cells on a planar surface of a reflector unit rather than concentric channels and further note that the plan outline of the reflector can be rectangular or elliptical rather than circular as shown. In any event, concentric channels or cavities, if used, should follow the reflector rim.

Figure 3A:
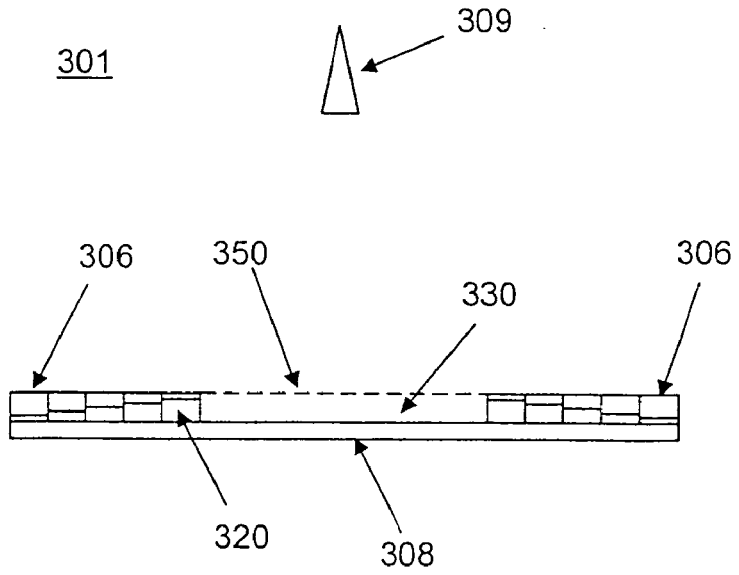
FIG. 3A is a side view of a portion of the antenna system of FIG. 3.

Referring to FIGS. 3 and 3A, a schematic diagram and a side view respectively of an antenna system 300 having at least one cavity (and in this embodiment a plurality of cavities 306) that can contain at least one fluidic dielectric 320 having a permittivity and a permeability is shown. The cavities 306 can be a plurality of tubes such as quartz capillary tubes formed within an reflector unit 301. The antenna 300 can further include at least one composition processor or pump 304 adapted for dynamically changing a composition of the fluidic dielectric to vary at least the permittivity and/or permeability in any of the plurality of cavities 306. The composition processor can also change the volume of fluidic dielectric 320 in each of the plurality of cavities 306 and optionally in a central cavity 350 with fluidic dielectric 330. It should be understood that the at least one composition processor can be independently operable for adding and removing the fluidic dielectric from each of said plurality of cavities. The fluidic dielectric can be moved in and out of the respective cavities using feed lines 307 for example. The antenna 300 can further include a controller or processor 302 for controlling the composition processor 304 to dynamically vary at least one among volume, the permittivity and/or the permeability in at least one of the plurality of cavities in response to a control signal. Preferably, the reflector unit 301 comprises a main solid dielectric reflector portion 308 having at least one cavity placed on a peripheral area of the reflector portion 308. As previously mentioned the at least one cavity can comprise a plurality of concentric tubes or a matrix of cells or chambers. The reflector portion 308 and cavities 306 are preferably spaced apart from a feed horn or radiator 309 wherein the cavity or cavities are arranged so that any radiated signal from the radiator 309 would enter the cavity or cavities (306) before being reflected (or not reflected as the case may be) by the reflector portion 308. Of course this applies only to locations where the cavities exist and not to locations where the radiated signal directly hits the reflector portion 308 (where no intervening cavity exists). The concentric tubes can ideally be quartz capillary tubes, although the invention is not limited thereto. In this manner, the antenna system 300 can adjust and even dynamically adjust the amplitude taper across the surface or aperture of the antenna. Preferably, side lobes in such a configuration should be less than −13 dB. By providing the amplitude control across the aperture using the appropriate apportioning and/or mixture of fluidic dielectric within the cavities on peripheral area of the reflector portion, such side lob effects can be effectively attenuated. As previously described, the fluidic dielectric used in the cavities can be comprised of an industrial solvent having a suspension of magnetic particles. The magnetic particles are preferably formed of a material selected from the group consisting of ferrite, metallic salts, and organo-metallic particles although the invention is not limited to such compositions.

Referring again to FIG. 3, the controller or processor 302 is preferably provided for controlling operation of the antenna 300 in response to a control signal 305. The controller 302 can be in the form of a microprocessor with associated memory, a general purpose computer, or could be implemented as a simple look-up table.

For the purpose of introducing time delay or energy shaping in accordance with the present invention, the exact size, location and geometry of the cavity structure as well as the permittivity and permeability characteristics of the fluidic dielectric can play an important role. The processor and pump or flow control device (302 and 304) can be any suitable arrangement of valves and/or pumps and/or reservoirs as may be necessary to independently adjust the relative amount of fluidic dielectric contained in the cavities 306. Even a MEMS type pump device (not shown) can be interposed between the cavity or cavities and a reservoir for this purpose. However, those skilled in the art will readily appreciate that the invention is not so limited as MEMS type valves and/or larger scale pump and valve devices can also be used as would be recognized by those skilled in the art.

The flow control device can ideally cause the fluidic dielectric to completely or partially fill any or all of the cavities 306 (or cavities 406 and/or 416 in FIG. 4). The flow control device can also cause the fluidic dielectric to be evacuated from the cavity into a reservoir. According to a preferred embodiment, each flow control device is preferably independently operable by controller 302 so that fluidic dielectric can be added or removed from selected ones of the cavities 306 to produce the required amount of delay indicated by a control signal 305.

Propagation delay of signals in the dielectric lens antenna can be controlled by selectively controlling the presence and removal or mixture of fluidic dielectric from the cavities 106. Since the propagation velocity of a signal is approximately inversely proportional to $\sqrt{\mu\epsilon}$, the different permittivity and/or permeability of the fluidic dielectric as compared to an empty cavity (or a cavity having a different mixture with different dielectric properties) will cause the propagation velocity (and therefore the amount of delay introduced)) to be different. For example, as shown in FIG. 3A, various volumes (and resulting "heights") of a particular composition of fluidic dielectric 320 can be placed in each of the cavities 306 such that signals traveling in and out of particular "column" of dielectric fluid will vary in speed based on the "height" of the column. If the same fluid is used throughout cavities (306 and optionally 350), the signals traveling through the shorter columns on the outer periphery will travel faster than the signals traveling through the taller columns towards the center.

Of course, the composition of the fluid can be varied amongst the cavities to provide other steering of the signal independent of the volume. According to yet another embodiment of the invention, different ones of the cavities 306 can have different types of mixtures of fluidic dielectric contained therein so as to produce different amounts of delay for RF signals traversing the antenna 300. For example, larger amounts of delay can be introduced by using fluidic dielectrics with proportionately higher values of permittivity and permeability. Using this technique, coarse and fine adjustments can be effected in the total amount of delay introduced or in the desired energy shaping of the radiated signal.

As previously noted, the invention is not limited to any particular type of structure. The cavities do not necessarily need to be tubes or in concentric arrangements as shown, but can be formed in various arrangements to accomplish the objectives of the present invention. Preferably though, the cavities should reside between the source of radiation or radiator and the reflective surface Composition of the Fluidic Dielectric The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay or radiated energy shape. In this regard, it will be readily appreciated that fluid miscibility can be a key consideration to ensure proper mixing of the component parts of the fluidic dielectric.

The fluidic dielectric also preferably has a relatively low loss tangent to minimize the amount of RF energy lost in the antenna. Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity (er) for fluids is approximately 2.0. However, the fluidic dielectric used herein can include fluids with higher values of permittivity. For example, the fluidic dielectric material could be selected to have a permittivity values of between 2.0 and about 58, depending upon the amount of delay or energy shape required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 μm are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

The antennas of FIGS. 2–4 also reveal a method for energy shaping an RF signal comprising the steps of propagating the RF signal toward a reflector or sub-reflector and adding and removing a fluidic dielectric to at least one cavity on the reflector or sub-reflector to vary a propagation delay or energy shape of the RF signal in order to reduce the effects of side lobes generated by the feed. The method could also include the step of selectively mixing a fluidic dielectric from selected ones of a plurality of cavities of the antenna in response to a control signal. It should be understood within contemplation of the present invention that the mixing could occur before the fluidic dielectric is moved into the cavity of the reflector unit or could also be mixed in the cavity of the reflector unit itself. The method could also include the step of selecting a permeability and a permittivity for said fluidic dielectric for maintaining a constant characteristic impedance along an entire length of at least one cavity. It should also be noted that the step of adding and removing or mixing a fluidic dielectric can comprise the step of mixing fluidic dielectric in a given cavity (or cavities) to obtain a desired permeability and permittivity. According to a preferred embodiment, each cavity can be either made full or empty of fluidic dielectric in order to implement the required time delay or energy shape. However, the invention is not so limited and it is also possible to only partially fill or partially drain the fluidic dielectric from one or more of the cavities.

In either case, once the controller has determined the updated configuration for each of the cavities necessary to implement the time delay or energy shape, the controller can operate device 304 to implement the required delay/shape. The required configuration can be determined by one of several means. One method would be to calculate the total time delay for each cavity or for all the cavities at once. Given the permittivity and permeability of the fluid dielectrics in the cavities, and any surrounding solid dielectric (308 in FIG. 3 or 408 in FIG. 4 for example), the propagation velocity could be calculated for the reflector unit. These values could be calculated each time a new delay time request is received or particular energy is required or could be stored in a memory associated with controller or processor 302.

As an alternative to calculating the required configuration for a given delay or energy shape, the controller 302 could also make use of a look-up-table (LUT). The LUT can contain cross-reference information for determining control data for fluidic delay units necessary to achieve various different delay times and energy shapes. For example, a calibration process could be used to identify the specific digital control signal values communicated from controller 302 to the cavities that are necessary to achieve a specific delay value or energy shape. These digital control signal values could then be stored in the LUT. Thereafter, when control signal 105 is updated to a new requested delay time, the controller 302 can immediately obtain the corresponding digital control signal for producing the required delay.

As an alternative, or in addition to the foregoing methods, the controller 302 could make use of an empirical approach that injects a signal at an RF input port and measures the delay to an RF output port. Specifically, the controller 302 could check to see whether the appropriate time delay or energy shape had been achieved. A feedback loop could then be employed to control the flow control devices (304) to produce the desired delay characteristic.

Referring to FIG. 4, a schematic diagram of an antenna system 400 using a reflector unit 401 and a sub-reflector unit 411 is shown. The reflector unit has at least one cavity or a plurality of cavities 406 that can contain at least one fluidic dielectric arranged to reside on or in a reflector portion 408. Likewise, the sub-reflector unit has a plurality of cavities 416 that can also contain at least one fluidic dielectric. The cavities 406 and 416 can be a plurality of concentric tubes such as quartz capillary tubes on the outer periphery of the respective reflector unit 401 or sub-reflector unit 411, although the invention is not limited to such arrangement in terms of cavities and construction. The antenna 400 can further include at least one composition processor or pump, controller, & respective feed lines (not shown) all as similarly discussed with respect to FIG. 2 which is similarly adapted for dynamically changing a composition of the fluidic dielectric to vary at least the permittivity and/or permeability in any of the plurality of cavities 406 or 416. Preferably, the reflector unit 401 comprises a main solid dielectric reflector portion 408 having cavities 406 or a plurality of concentric tubes on a peripheral area of the reflector portion 408. The sub-reflector unit 411 preferably comprises a main solid dielectric sub-reflector portion 418 having cavities 416 or a plurality of concentric tubes on a peripheral area of the sub-reflector portion 418. Preferably, at least one feed horn 409 or additional feed horns (407) are spaced between the reflector unit 401 and the sub-reflector unit 411 as shown. The concentric tubes can ideally be quartz capillary tubes, although the invention is not limited thereto. Alternatively, the reflector unit 401 and or sub-reflector unit 411 can be completely formed by a concentric series of cavities 406 or 416 respectively without using a solid dielectric member (408 or 418) in a center area. If one feed horn is used, it is preferably placed at a focal point 410. If more than one feed horn is used as shown, the feed horns are preferably spaced equi-distant from the focal point or equally unfocused from such focal point.

The present invention is ideally applicable to any reflector or sub-reflector type antenna. Operationally, the present invention enables a system designer to alter the size of the reflective surface for a given application or frequency range. The present invention adds further flexibility by controlling the reflection off the surface of the reflectors by dynamically changing the size of the surface with the fluidic dielectric. In essence, the reflector size can be made to vary based on the frequency or application as opposed to existing systems that are constructed on the basis of fixed frequencies since feeds are frequency dependent generally. In this manner, sidelobes created by different feed horns and frequencies can each be independently averted and not reflected as required by manipulating the size of the reflectors or sub-reflectors using the fluidic dielectric. In one embodiment, when the fluidic dielectric is present, the reflector or sub-reflector is effectively extended in size and when the fluidic dielectric is removed the reflector or sub-reflector is effectively reduced in size. The present invention essentially can simulate physical edge treatment of microwave antennas that dictate a smooth tapered window onto the Rayleigh-Sommerfeld diffraction formula. It can simulate serrated and rolled edge treatments where serrated edge treatments are primarily used for magnitude tapering of the electromagnetic field at the aperture of a microwave antenna and rolled edge treatments are primarily used for phase tapering with little controls on the magnitude. Magnitude and phase are the two independent components of an electromagnetic field. Any abrupt change in either component will lead to high side lobes. Both serrated and rolled edge treatments are restricted to a single component, neglecting the other. The abrupt change can not be optimally removed with either of these two methods. The present invention can treat both components simultaneously and provide a better optimum method than either of them in a dynamic manner.

Those skilled in the art will recognize that a wide variety of alternatives could be used to adjust the presence or absence or mixture of the fluid dielectric contained in each of the cavities. Additionally, those skilled in the art should also recognize that a wide variety of configurations in terms of cavities and reflectors or sub-reflectors could also be used with the present invention. The reflector or sub-reflector of the present invention can be assembled in a configuration that resembles a reflector in forms such as parabolic, circular, flat, etc, depending on the desires of the designer for the available or desired beam patterns antenna. Accordingly, the specific implementations described herein are intended to be merely examples and should not be construed as limiting the invention.

We claim:

1. A reflector antenna, comprising:

a reflector unit having at least one cavity disposed in the reflector unit;

at least one fluidic dielectric having a permittivity and a permeability and selectively disposed within said at least one cavity;

at least one composition processor capable of dynamically changing a composition of said fluidic dielectric to vary at least one of said permittivity and said permeability in said at least one cavity; and a controller for controlling said at least one composition processor in response to a control signal.

2. The reflector antenna of claim 1, wherein the reflector antenna further comprises a feed for radiating a signal towards the reflector unit.

3. The reflector antenna of claim 2, wherein said at least one cavity disposed in the reflector unit further comprises a plurality of cavities formed in a peripheral area of the reflector unit.

4. The reflector antenna of claim 3, wherein a plurality of concentric tubes forms the plurality of cavities.

5. The reflector antenna of claim 4, wherein the plurality of concentric tubes comprises quartz capillary tubes.

6. The reflector antenna of claim 1, wherein the reflector unit comprises a solid dielectric substrate having said at least one cavity formed in a peripheral area of the solid dielectric substrate.

7. The reflector antenna of claim 3, wherein said at least one composition processor is independently operable for adding and removing said fluidic dielectric from each of said plurality of cavities.

8. The reflector antenna according to claim 1, wherein said fluidic dielectric is comprised of an industrial solvent.

9. The reflector antenna according to claim 8, wherein said fluidic dielectric is comprised of an industrial solvent that has a suspension of magnetic particles contained therein.

10. The reflector antenna according to claim 9, wherein said magnetic particles are formed of a material selected from the group consisting of ferrite, metallic salts, and organo-metallic particles.

11. The reflector antenna according to claim 1 further comprising a sub-reflector unit and at least one feed horn spaced between the reflector unit and the sub-reflector unit.

12. The reflector antenna according to claim 11, wherein the sub-reflector unit further comprises a plurality of cavities capable of having at least one fluidic dielectric therein.

13. The reflector antenna according to claim 1, wherein the at least one cavity comprises a single cavity formed on the periphery of the reflector unit.

* * * * *